US005920909A

United States Patent [19]

Ellsworth et al.

[11] Patent Number: 5,920,909

[45] Date of Patent: Jul. 13, 1999

[54] HAIR WRAP

[76] Inventors: Shawna K. Ellsworth, 665 S. 39th St., Mesa, Ariz. 85206; Dortha May Crabtree, 2407 Legion St., Carlsbad, N.M. 88220

[21] Appl. No.: 08/676,071

[22] Filed: Jul. 5, 1996

[51] Int. Cl.[6] ..... A41D 20/00

[52] U.S. Cl. ..... 2/171; 2/174; 2/DIG. 11; 132/273

[58] Field of Search ..... 2/171, 174, 202, 2/203, 204, 207, 208, 209, 91, 209.3, 181.2, 300, 301, 302, 303, 304, 305, 306, 307, 308, 309, 310, 311, 312, 313, 314, 315, 316, 317, 318, 319, 320, 321, 322, 338, DIG. 11; 4/515, 520, 521; 132/212, 273, 274

[56] References Cited

U.S. PATENT DOCUMENTS

| | | | |
|---|---|---|---|
| 427,263 | 5/1890 | Frey | 2/203 |
| 1,172,927 | 2/1916 | Bloch . | |
| 2,211,184 | 8/1940 | Varell | 2/174 |
| 2,458,696 | 1/1949 | Elias | 2/110 |
| 2,579,089 | 12/1951 | Price . | |
| 2,889,557 | 6/1959 | Blair . | |
| 2,996,724 | 8/1961 | Rose et al. | 2/171 |
| 3,131,400 | 5/1964 | Blanchard et al. . | |
| 3,197,787 | 8/1965 | Tognan et al. | 2/174 |
| 3,268,913 | 8/1966 | Gettinger . | |
| 5,007,115 | 4/1991 | Denbow et al. | 2/202 |
| 5,144,696 | 9/1992 | Kahl | 2/311 X |
| 5,218,723 | 6/1993 | McLaughlin | 2/209.3 |
| 5,621,921 | 4/1997 | Outland | 2/DIG. 11 |
| 5,806,535 | 9/1998 | Becker | 2/171 |

FOREIGN PATENT DOCUMENTS

| | | | |
|---|---|---|---|
| 2171 | 2/1886 | United Kingdom | 2/202 |

*Primary Examiner*—Diana L. Oleksa
*Attorney, Agent, or Firm*—John D. Lister

[57] ABSTRACT

A hair wrap confines the hair of the wearer while the wearer is engaged in activities where the wearer desires to keep her/his hair confined and not falling over her/his face or otherwise interfering with such activities. Preferably, the hair wrap is annular with upper and lower annular edges, having elastic therein, defining upper and lower expandable openings which permit the hair wrap to be placed over the head and down around the neck of the wearer. A pliable material, intermediate the upper and lower annular edges of the hair wrap provides a pocket at the rear of the hair wrap for receiving the hair of the wearer. In use, the hair wrap is passed over the head and down around the neck of the wearer with the hair of the wearer extending over the rear portion of the hair wrap. The front of the hair wrap is then raised above the forehead and the hair extending over the rear of the hair wrap is inserted into the rear pocket of the hair wrap to confine the hair.

2 Claims, 2 Drawing Sheets

20
24
22
26
32
6
6

20
22
26

20
22
24
26
32

28
34
36
30
24
22
26

20
32
5
5
24
22
34
26
36
4
4

HAIR WRAP

BACKGROUND OF THE INVENTION

The present invention relates to a hair wrap, and, in particular, to a simply constructed, low cost, easy to use hair wrap that effectively keeps the hair of the wearer confined while the wearer applies or removes makeup, washes her/his face, or is otherwise engaged in activities where the hair is preferably confined and kept out of the face of the wearer.

There are numerous head coverings such as boudoir caps, sleep turbans, and the like which confine the hair of the wearer. Examples of such head coverings are disclosed in the following U.S. Patents: Price, U.S. Pat. No. 2,579,089, issued Dec. 18, 1951; Blair, U.S. Pat. No. 2,889,557, issued Jun. 9, 1959; and Gettinger, U.S. Pat. No. 3,268,913, issued Aug. 30, 1966. These head covering are placed over the head of the wearer and unless the wearer's hair is very short or in curlers or the like, these head coverings require the wearer to tuck her/his hair up under the head covering. Tucking one's hair up under a head covering can be somewhat tedious and time consuming especially when the wearer has long hair. Bathing caps such as the bathing cap disclosed in the patent to Bloch, U.S. Pat. No. 1,172,927, issued Feb. 22, 1916, and the bathing cap, with its protective head band, disclosed in the patent to Blanchard et al, U.S. Pat. No. 3,131,400, issued May 15, 1964, are also placed over the head of the wearer and require the wearer to tuck her/his long hair up under the cap. Accordingly, there has been a need for a hair wrap, such as the hair wrap of the present invention which is both inexpensive and easy to use, for confining the hair of the wearer, especially long hair, and keeping the hair of the wearer out of the face of the wearer.

SUMMARY OF THE INVENTION

The hair wrap of the present invention is annular in shape with upper and lower annular edges, having elastic bands or the like, defining upper and lower expandable openings which permit the hair wrap to be placed over the head and down around the neck of the wearer. A pliable material, such as cotton cloth or other common fabric, intermediate the upper and lower annular edges of the hair wrap provides a pocket in the rear portion of the hair wrap for receiving the hair of the wearer. In use, the hair wrap is passed over the head and down around the neck of the wearer. The hair of the wearer is extended over the upper edge of the rear portion of the hair wrap and the front of the hair wrap is then raised, preferably, to a location immediately above the upper portion of the forehead or immediately behind the hair line of the wearer. The hair extending over the upper edge of the rear portion of the hair wrap is then grasped and easily inserted into the pocket of the hair wrap to confine the hair and keep the hair out of the face of the wearer. With the hair wrap in place, the wearer can put on or take off makeup, wash her/his face, sleep or otherwise engage in activities, including bending over a sink, without her/his hair interfering with such activities. When the wearer desires to remove the hair wrap, the hair wrap is easily removed by grasping the hair wrap at the front of the hair wrap and pulling the hair wrap backward off the head of the wearer.

DESCRIPTION OF THE PREFERRED EMBODIMENTS

As shown in FIGS. 2–6, the hair wrap 20 of the present invention comprises an annular piece of pliable material 22 having upper and lower annular edges, 24 and 26 respectively. The upper and lower annular edges 24 and 26 each include an elastic means, such as an elastic band 28 and 30, and define expandable and contractible upper and lower openings of the hair wrap 20.

Figures 2, 3, 4, 5, 6:
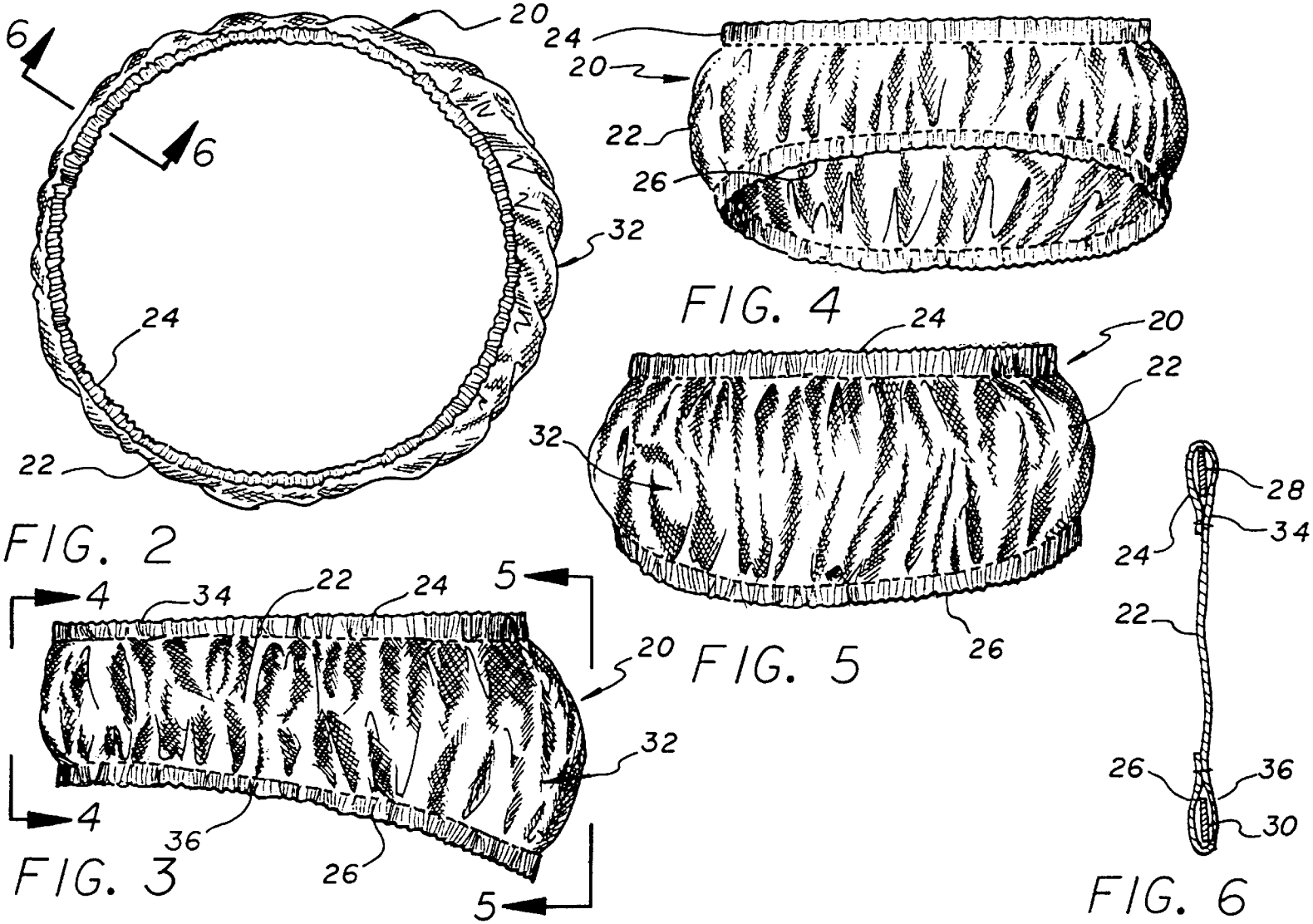
FIG. 2 is a view from above of the hair wrap of the present invention.
FIG. 3 is a side view of the hair wrap of the present invention.
FIG. 4 is a front view of the hair wrap of the present invention taken substantially along lines 4—4 of FIG. 3.
FIG. 5 is a rear view of the hair wrap of the present invention taken substantially along lines 5—5 of FIG. 3.
FIG. 6 is a vertical section through the hair wrap of the present invention taken substantially along lines 6—6 of FIG. 2.

As best shown in FIGS. 3–5, preferably, the width of the annular piece of pliable material 22 is greater at the rear of the hair wrap 20 than at the front of the hair wrap and forms a pocket 32 at the rear of the hair wrap for receiving the hair of the wearer. Typically, the annular piece of pliable material 22 has one vertical seam where the ends of a flat blank of pliable material (not shown) are sewn together to form the annular piece of pliable material 22. To minimize scrap, successive flat blanks of pliable material, cut from a large piece of the pliable material, may be shaped complementary with respect to each other with the free ends of the blanks of the pliable material being located alternately at the widest and narrowest portions of the blanks. Thus, the vertical seams of successive hair wraps made from such blanks would alternate between the rear and the front of the hair wrap 20. Although the upper annular edge 24 of the hair wrap 20 need not be straight, the upper annular edge 24 of the hair wrap 20 is, preferably, straight for ease of sewing and when laid flat in an unexpanded condition, the hair wrap 20, typically, measures about eight and one-half inches long by about three and one-half inches high in the front and about six and one-half inches high in the rear. The pliable material of the hair wrap is preferably a pliable material made by weaving, felting or knitting natural or synthetic fibers and filaments, such as cotton cloth.

Preferably, the upper and lower annular edges 24 and 26 of the hair wrap 20 have hems 34 and 36 therein which are shown in FIG. 6 and contain the elastic bands 28 and 30. Preferably, the hems 34 and 36 of the hair wrap slide relative to the elastic bands 28 and 30 to facilitate the expansion and contraction of the upper and lower openings of the hair wrap defined by the upper and lower annular edges. When the upper and lower openings of the hair wrap 20 are in the contracted state, the upper and lower openings of the hair wrap are smaller than a horizontal section through the wearer's head (hereinafter "the head size of the wearer") so that the hair wrap grips the head of the wearer and there are a multitude of vertically extending or substantially vertically extending folds in the pliable material 22 of the hair wrap. When the upper and lower openings of the hair wrap 20 are in an expanded state and the hair wrap is ready to be placed over the head of the wearer, the upper and lower openings of the hair wrap 20 are larger than the head size of the wearer and the folds in the pliable material 22 are at least reduced in size as a result of the expansion of the hair wrap.

In another embodiment of the hair wrap 20 (not shown), elastic materials, such as elastic bands, in an expanded condition can be sewn directly to the upper edge and the lower edge of a blank of the pliable material 22. When the elastic materials contract, vertically extending or substantially vertically extending folds are formed in the pliable material 22. The front or rear vertical seam of the hair wrap is then sewn to complete the fabrication of the hair wrap. As with the hair wrap 20 shown in FIGS. 1–6, when this embodiment of the hair wrap is expanded to fit over the head of the wearer, the vertically extending folds are reduced in size to permit the expansion of the hair wrap. However, the hair wrap 20, with the elastic bands 28 and 30 confined within the hems 34 and 36, is more comfortable to wear than this embodiment of the hair wrap.

Figure 1A:
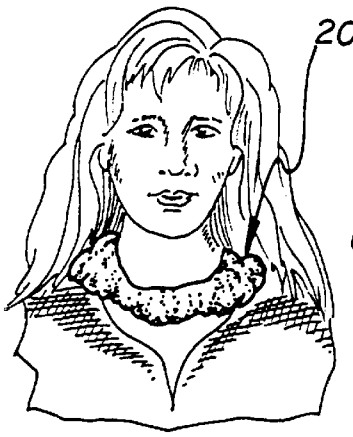
FIGS. 1A–1H show the hair wrap of the present invention being placed on the head of a wearer to contain the hair of the wearer; in place on the head of the wearer; and being removed from the head of the wearer.
Figure 1B:
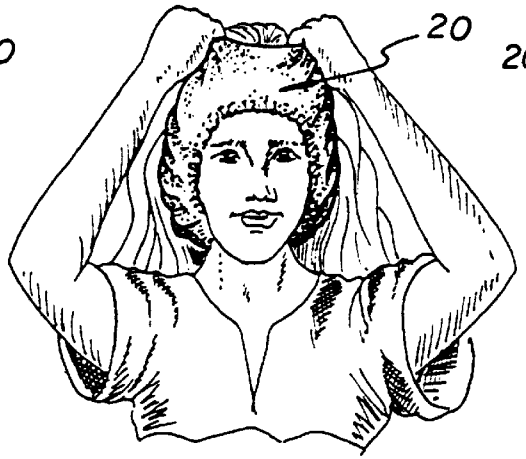
Figure 1C:
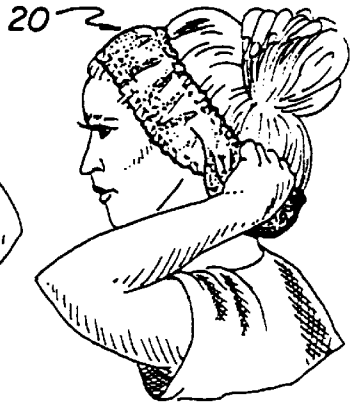
Figure 1D:
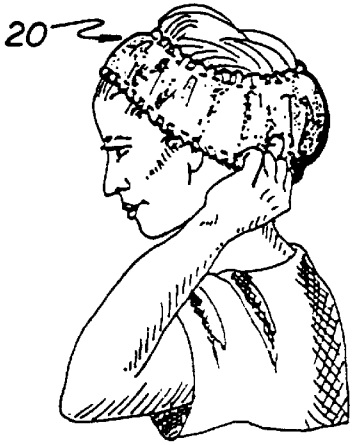
Figure 1E:
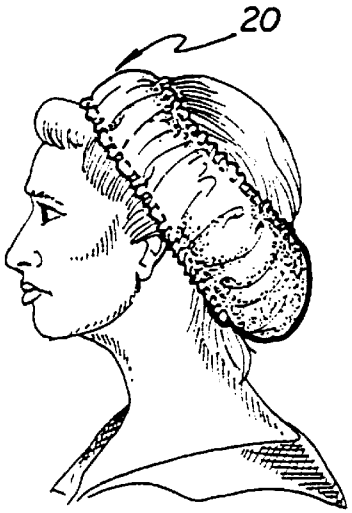
Figure 1F:
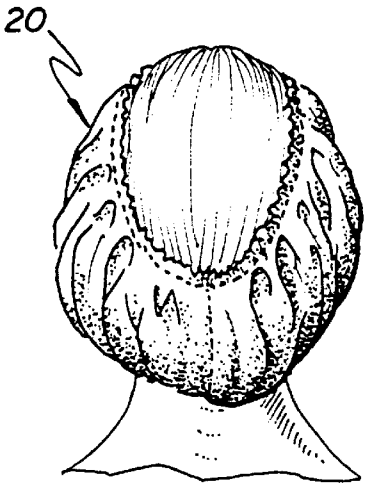
Figure 1G:
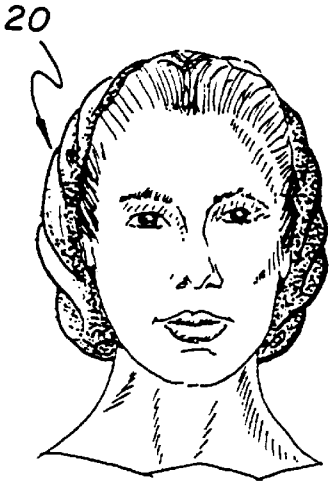
Figure 1H:
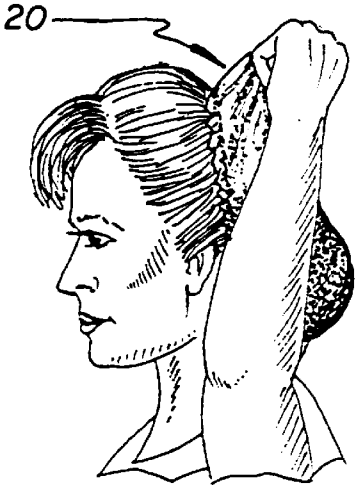

The hair wrap 20 is shown in use in FIGS. 1A–1H. The hair wrap is first expanded so that the upper and lower openings of the hair wrap are larger than the head size of the wearer and the hair wrap is passed down over the head of the wearer to the neck of the wearer as shown in FIG. 1A. The hair of the wearer is extended over the rear portion of the upper annular edge 24 of the hair wrap and the front portion of the hair wrap is raised, as shown in FIG. 1B, to a location at or above the hair line or above the forehead of the wearer, as shown in FIG. 1C. This sweeps the hair of the wearer, at the front of the wearer's head, back away from the face of the wearer and, as the hair wrap contracts and grips the head of the wearer, keeps this hair out of the wearer's face. As shown in FIG. 1C, the wearer grasps her/his hair that has been extended over the rear portion of the upper annular edge 24 of the hair wrap with one hand and easily inserts the hair into the rear pocket 32 of the hair wrap 20, as shown in FIG. 1D, while holding the upper edge of the rear portion of the hair wrap 20 away from the head with her/his other hand. The rear portion of the hair wrap is then released and the hair of the wearer is now confined by the hair wrap 20, as shown in FIGS. 1E–1G. The wearer is now free to engage in various activities, including those which require head movement and bending over a sink, etc. such as putting on or removing makeup, applying and removing facials, and washing the face, without having her/his hair interfere with her/his activities. When the wearer desires to remove the hair wrap 20, the wearer merely grasps the front portion of the hair wrap and pulls the hair wrap back over the head.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A hair wrap for containing the hair of a wearer and keeping the hair of the wearer confined and away from the face of the wearer, comprising:

an annular strip of pliable cloth material having an upper annular edge and a lower annular edge; said upper annular edge defining an upper annular opening of the hair wrap; said lower annular edge defining a lower annular opening of the hair wrap directly below the upper annular opening; said upper annular edge of said upper annular opening and said lower annular edge of said lower annular opening each having an elastic means for permitting said upper and lower annular openings to be expandable from a first size adapted to be smaller than the head size of a wearer wherein said upper and lower annular edges of said upper and lower openings may grip the head of a wearer to a second expanded size adapted to be greater than the head size of a wearer wherein said upper and lower annular edges of said upper and lower openings can be passed over the head of a wearer and down around the neck of the wearer; and said annular strip of pliable cloth material being about 6 ½ inches in width between said upper annular edge and said lower annular edge of the hair wrap at a rear portion of the hair wrap and about 3 ½ inches in width between said upper annular edge and said lower annular edge at a front portion of the hair wrap and forming a pocket in said rear portion of the hair wrap for containing the hair of a wearer whereby in use the hair wrap may be expanded and passed down over the head of a wearer to the neck of the wearer, the hair of the wearer may be extended over the rear portion of said upper opening of the hair wrap, the front of the hair wrap may be raised to a location above the forehead of the wearer to pull back the hair of the wearer from the face of the wearer, the hair wrap may be allowed to contract to grip the head of the wearer, and the hair of the wearer may extend over the rear portion of said upper opening of the head wrap and may be inserted into the pocket to confine the hair of the wearer.

2. The hair wrap of claim 1, wherein: said elastic means of said upper annular edge and said lower annular edge of said annular piece of said pliable material each comprises an elastic band confined within a hem of said annular piece of pliable material and each of said hems can move relative to said elastic band contained within said hem to facilitate expansion and contraction of said hair wrap.

* * * * *